US008641309B2

(12) United States Patent
Perry et al.

(10) Patent No.: US 8,641,309 B2
(45) Date of Patent: Feb. 4, 2014

(54) SURFACE TREATING IMPLEMENT

(75) Inventors: Joseph P. Perry, Comstock Park, MI (US); Herbert J. Vanderbilt, Lowell, MI (US); Kevin Haley, Byron Center, MI (US); Donald J. Mahaffy, Zeeland, MI (US); Justin Benacquisto, Caledonia, MI (US); Kelli A. Cain, Grand Rapids, MI (US); Kenneth M. Lenkiewicz, Grand Rapids, MI (US); James A. Krzeminski, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 859 days.

(21) Appl. No.: 12/672,359

(22) PCT Filed: Aug. 7, 2008

(86) PCT No.: PCT/US2008/072439

§ 371 (c)(1),
(2), (4) Date: Feb. 5, 2010

(87) PCT Pub. No.: WO2009/021103

PCT Pub. Date: Feb. 12, 2009

(65) Prior Publication Data

US 2011/0179591 A1 Jul. 28, 2011

Related U.S. Application Data

(60) Provisional application No. 60/954,460, filed on Aug. 7, 2007.

(51) Int. Cl.

| | |
|---|---|
| ***A47L 13/00*** | (2006.01) |
| ***A47L 13/11*** | (2006.01) |
| ***A47L 13/19*** | (2006.01) |
| ***A47L 13/20*** | (2006.01) |
| ***A47L 13/22*** | (2006.01) |
| ***A46B 11/02*** | (2006.01) |
| ***A46B 11/04*** | (2006.01) |

(52) U.S. Cl.
USPC ..... 401/139; 401/137; 401/138; 401/140; 401/190; 401/268; 401/286; 401/287

(58) Field of Classification Search
USPC ..... 401/136, 137, 138, 139, 140, 190, 286, 401/287
See application file for complete search history.

(56) References Cited

U.S. PATENT DOCUMENTS

| | | | | |
|---|---|---|---|---|
| 3,679,319 | A | 7/1972 | Munchel et al. | |
| 3,783,474 | A * | 1/1974 | Fairaizl et al. | 15/369 |

(Continued)

FOREIGN PATENT DOCUMENTS

| | | | |
|---|---|---|---|
| DE | 10205507 | A1 | 8/2003 |
| EP | 0035981 | A1 | 9/1981 |

(Continued)

*Primary Examiner* — David J. Walczak
*Assistant Examiner* — Joshua Wiljanen
(74) *Attorney, Agent, or Firm* — McGarry Bair PC

(57) ABSTRACT

A surface treating implement (10) according to the invention comprises a body (14) comprising a container receiver (36) and a nozzle assembly (26) comprising a fluid conduit fluidly (72) connected to the container receiver (36). At least one container (16) is selectively mounted to the container receiver (36) and contains a predetermined amount of a treating composition and has a dispensing opening (102) in fluid communication with the fluid conduit (72). A handle (12) is associated with the body (14). The nozzle assembly (26) is mounted to the body (14) for selective displacement a predetermined distance to release the treating composition from the container (16) through the fluid conduit (72) and onto a surface to be treated.

16 Claims, 10 Drawing Sheets

(56) References Cited

U.S. PATENT DOCUMENTS

| | | | | |
|---|---|---|---|---|
| 3,850,656 | A | 11/1974 | Brown | |
| 5,735,620 | A | 4/1998 | Ford | |
| 6,000,088 | A | 12/1999 | Wright et al. | |
| 6,579,023 | B2 | 6/2003 | Kunkler et al. | |
| 6,663,306 | B2 | 12/2003 | Policicchio et al. | |
| 6,663,307 | B2 | 12/2003 | Kopanic et al. | |
| 6,663,309 | B2 | 12/2003 | Zamansky et al. | |
| 6,692,172 | B1 * | 2/2004 | Hsu | 401/138 |
| 6,701,578 | B1 | 3/2004 | Lu | |
| 6,779,235 | B2 | 8/2004 | Newman et al. | |
| 6,789,705 | B2 | 9/2004 | Drew | |
| 6,820,301 | B2 | 11/2004 | Petner | |
| 6,854,919 | B2 | 2/2005 | Neumann et al. | |
| 6,865,776 | B2 | 3/2005 | Spinelli | |
| 6,866,165 | B2 | 3/2005 | Heathcock et al. | |
| 6,868,989 | B2 | 3/2005 | Fahy et al. | |
| 6,953,299 | B2 | 10/2005 | Wang et al. | |
| 6,960,042 | B1 * | 11/2005 | Hsiao | 401/138 |
| 7,004,671 | B2 | 2/2006 | Tawara et al. | |
| 7,007,338 | B2 | 3/2006 | Garabedian, Jr. et al. | |
| 7,048,458 | B2 * | 5/2006 | Hall et al. | 401/140 |
| 7,065,838 | B2 | 6/2006 | Mitchell et al. | |
| 7,163,349 | B2 | 1/2007 | Policicchio et al. | |
| 7,182,223 | B2 | 2/2007 | Healy et al. | |
| 7,618,206 | B2 * | 11/2009 | Sacks | 401/138 |
| 7,708,485 | B2 * | 5/2010 | Tanaka et al. | 401/138 |
| 2004/0141797 | A1 * | 7/2004 | Garabedian et al. | 401/279 |
| 2004/0144406 | A1 | 7/2004 | Garabedian et al. | |
| 2004/0146333 | A1 * | 7/2004 | Fu | 401/25 |
| 2005/0040644 | A1 | 2/2005 | Tawara et al. | |
| 2005/0158116 | A1 | 7/2005 | Belansky et al. | |
| 2006/0276730 | A1 | 12/2006 | Thiebaut et al. | |
| 2007/0122227 | A1 * | 5/2007 | Davis | 401/137 |
| 2007/0231046 | A1 * | 10/2007 | Whiffen et al. | 401/1 |
| 2008/0271272 | A1 | 11/2008 | Righetto | |
| 2012/0227763 | A1 * | 9/2012 | Hayes et al. | 134/6 |

FOREIGN PATENT DOCUMENTS

| | | | |
|---|---|---|---|
| EP | 1169962 | A1 | 1/2002 |
| GB | 2342403 | A | 12/2000 |
| KR | 20050103088 | | 4/2004 |
| KR | 20050100251 | A | 10/2005 |
| KR | 1020070078482 | A | 1/2007 |
| WO | 2005092146 | A1 | 10/2005 |
| WO | 2007028970 | A1 | 3/2007 |

* cited by examiner

SURFACE TREATING IMPLEMENT

CROSS-REFERENCE TO RELATED APPLICATIONS

This application is the national phase application from International Application No. PCT/US2008/072439, filed Aug. 7, 2008, which claims the benefit of U.S. Provisional Patent Application No.60/954,460, filed Aug. 7, 2007, both of which are incorporated herein in their entireties.

BACKGROUND OF THE INVENTION

1. Field of the Invention

This invention relates to a floor cleaning implement. In one of its aspects, the invention relates to a stick-type small area surface cleaning implement utilizing replaceable fluid container that is adapted to discharge fluid onto a surface to be cleaned.

2. Description of the Related Art

U.S. Pat. No. 3,679,319 to Munchel et al. discloses a stick-type cleaning implement for small areas of carpeted floor that includes a housing that mounts an aerosol cleaning solution dispenser in inverted relationship to a brush or other surface cleaning implement and has an actuation mechanism that opens the aerosol valve directly to the carpet when the housing is pressed into the surface to be cleaned.

US20050158116 to Belansky et al. discloses a cleaning apparatus having a body graspable by a user, a cleaning head at a distal end of the body, an aerosol canister with cleaning material mounted in the body, an interlocking device mounted on the canister to prevent inadvertent dispensing of the cleaning solution from the canister, and a lock-out feature that includes sloping walls and including a nipple, mounted within the body. The cleaning material is dispensed when a force is applied to the canister through the cleaning head U.S. Pat. No. 6,663,307 Kopanic et al. discloses a cleaning device comprising a housing configured to retain a spray canister, a segmented shaft assembly connected to the housing, and a handle assembly connected to the shaft assembly. The housing includes an aligning protrusion matingly received by a recess in the over cap on the canister. The handle assembly can include a trigger linked to a pivot link to spray the contents of the canister. Also disclosed are a variety of attachments positioned in front of the sprayer nozzle, including a translucent spraying attachment, a curved applicator attachment, and a rake attachment.

WO2007028970 to Brown discloses a device comprising a pressurized container having a nozzle with a sleeve of a containment skirt mounted thereto. The skirt 5 is pressed against a surface to be cleaned by a user causing the nozzle to move towards to pressurized container and release a jet of cleaning composition from the container. The skirt can have an absorbent pad removably attached thereto.

U.S. Pat. No. 6,789,705 to Drew discloses an apparatus for operating an aerosol dispenser from a distance. An elongated body receives the aerosol dispenser and mounts an extension pole and an actuation member. The extension pole mount is coaxially aligned with an aerosol dispenser-receiving cavity in the elongated body. The actuation member is movable between an at-rest position and a displaced position for spraying the contents of the aerosol dispenser.

U.S. Pat. No. 6,866,165 to Heathcock et al. discloses a trigger-actuated cleaning tool that moves an aerosol canister axially to expel the contents of the canister.

U.S. Pat. No. 6,663,306 to Pollicicchio et al. discloses a cleaning implement having a mop head attached to a handle and a liquid delivery system having a container filled with cleaning solution removably attached to a fitment. A disposable cleaning pad having an absorbent layer and an attachment layer is also disclosed.

U.S. Pat. No. 6,000,088 to Wright et al. discloses a suction cleaning device, wherein a user can push downward on the handle to spray water from a bottle of cleaning solution.

US20060276730 to Thiebaut et al. discloses a massaging device using an aerosol container and having a spray manifold to a textured surface, the spraying being actuated by axially displacing a spray valve relative to a housing of the device by applying force.

SUMMARY OF THE INVENTION

A surface treating implement according to the invention comprises a body comprising a container receiver and a nozzle assembly comprising a fluid conduit fluidly connected to the container receiver. At least one container is selectively mounted to the container receiver and contains a predetermined amount of a treating composition and has a dispensing opening in fluid communication with the fluid conduit. A handle is associated with the body. The nozzle assembly is mounted to the body for selective displacement with respect to the body of a predetermined distance to release the treating composition from the container through the fluid conduit and onto a surface to be treated.

In another embodiment, the surface treating implement further comprises a plurality of rake members formed on the nozzle assembly.

In another embodiment, at least one of the plurality of rake members comprises a ramped surface.

In another embodiment, the container receiver comprises a unique geometry that is complementary to a mating unique geometry on the container.

In another embodiment, the rake members are adapted to penetrate carpet fibers on the surface to be treated and at least one fluid distribution conduit is adapted to distribute the treating composition near a base of the carpet fibers.

In another embodiment, the surface treating implement further comprises a brush assembly adapted to agitate the surface to be treated after the treating composition has been applied to the surface to be treated.

In another embodiment, the brush assembly is mounted to the nozzle assembly.

In another embodiment the surface treating implement further comprises a squeegee assembly affixed to the body.

In another embodiment, the at least one container is an aerosol container adapted to dispense fluid under pressure.

In another embodiment, the at least one container is a liquid container adapted to dispense fluid by gravity feeding.

In another embodiment, the at least one container comprises at least one aerosol container and at least one liquid container.

In another embodiment, the nozzle assembly is rotatably mounted to the body for movement between a fluid retention position and a fluid discharge position.

In another embodiment, the container is an aerosol container having a valve stem and the nozzle assembly has an actuator that interfaces with the valve stem to displace the valve stem with respect to the container receiver to discharge the treating composition from the aerosol container as the nozzle assembly moves between the fluid retention position and the fluid discharge position.

In another embodiment, the container has a valved opening and the nozzle assembly has an actuator that interfaces with a valve in the valved opening to displace the valve with respect to the container receiver to discharge the treating composition from the container as the nozzle assembly moves between the fluid retention position and the fluid discharge position.

The treating composition can be any one of a variety of surface treating compositions for carpet or fabric surfaces or for bare floor surfaces. For example, the treating composition comprises a cleaning solution. Alternatively, the treating composition comprises a topical treatment. The topical treatment can be an anti-stain, anti-soil, miticide, or peroxide composition.

DESCRIPTION OF THE PREFERRED EMBODIMENT

Figure 1:
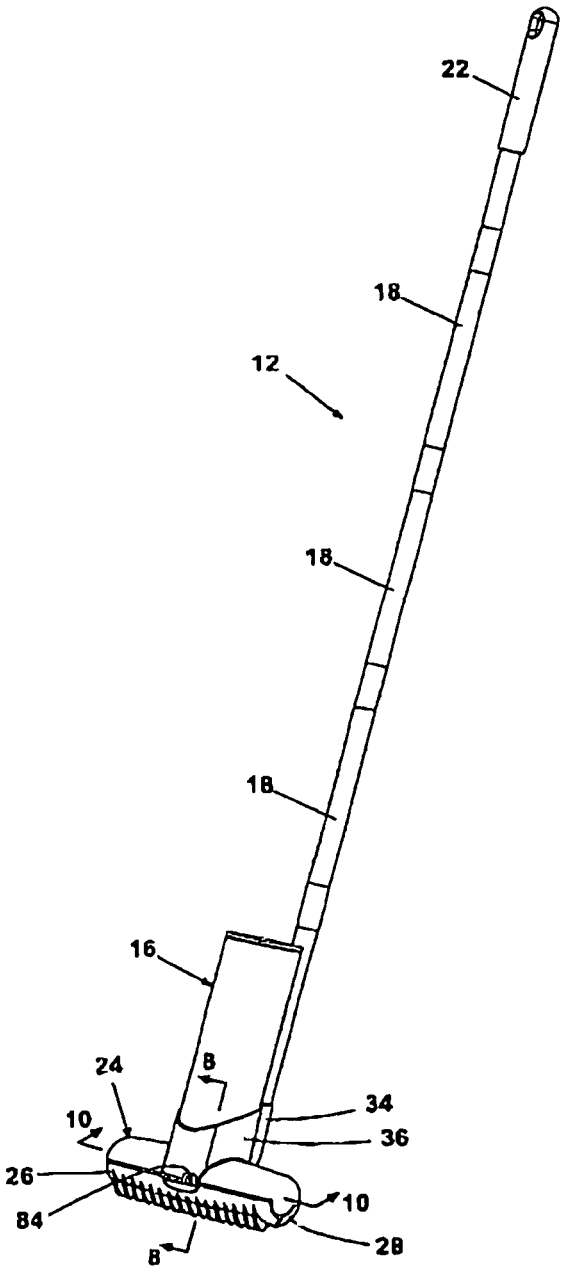
FIG. 1 is a perspective view of a stick cleaning implement according to the present invention.
Figure 2:
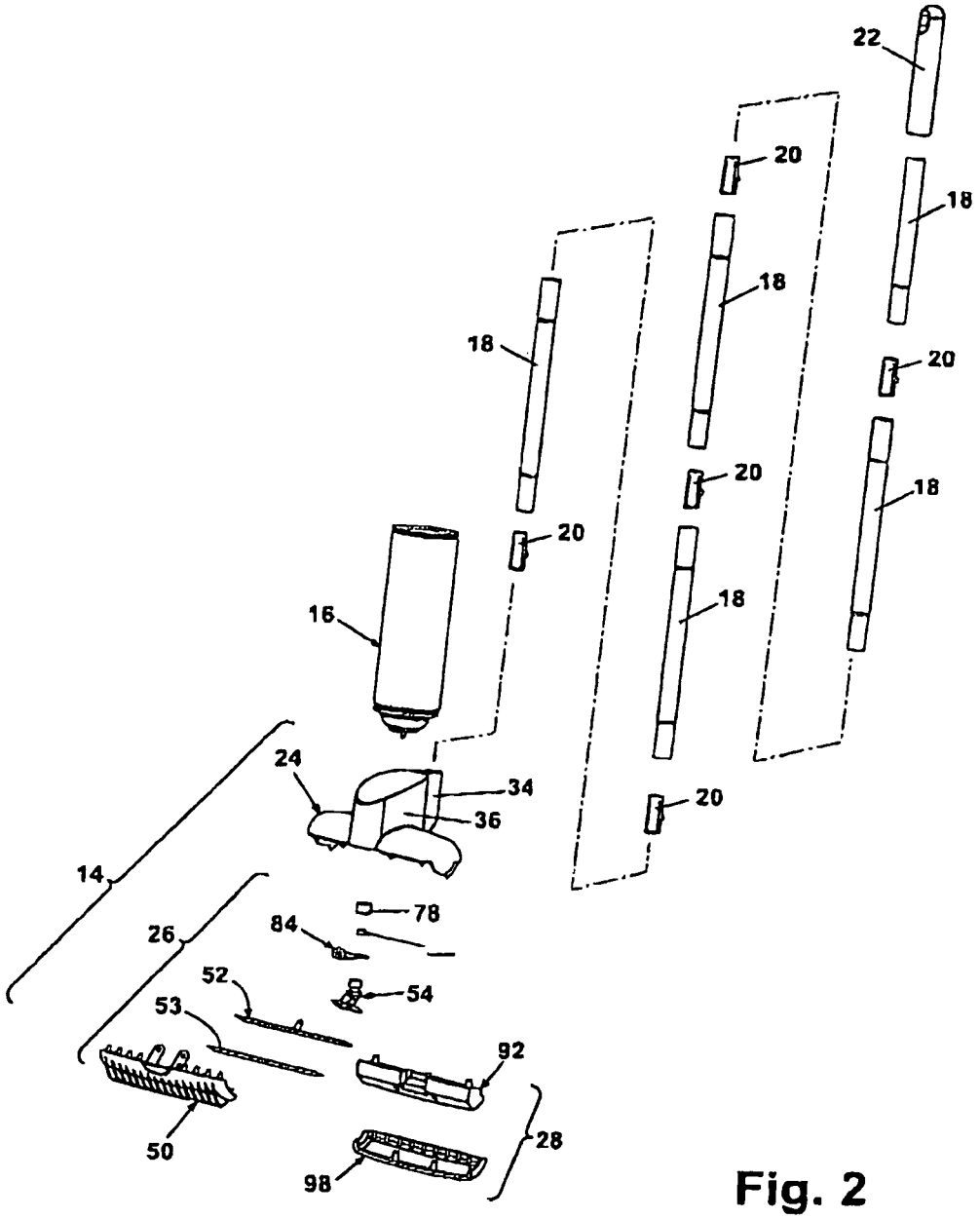
FIG. 2 is an exploded view of the stick cleaning implement of FIG. 1, showing a handle, a container, and a body at a lower portion thereof.

Referring to the drawings, and in particular to FIGS. 1 and 2, a small area carpet treating implement 10 in the form of a stick cleaner comprises a handle assembly 12, a body assembly 14 and a container 16 removably attached to the body assembly 14. The handle assembly 12 further comprises a plurality of handle segments 18 that are removably coupled via segment connectors 20 which are commonly used in the stick floor cleaning industry. A grip 22 provides a user interface at a first end of the handle assembly 12 while a second end is removably coupled to the body assembly 14.

Figure 3:
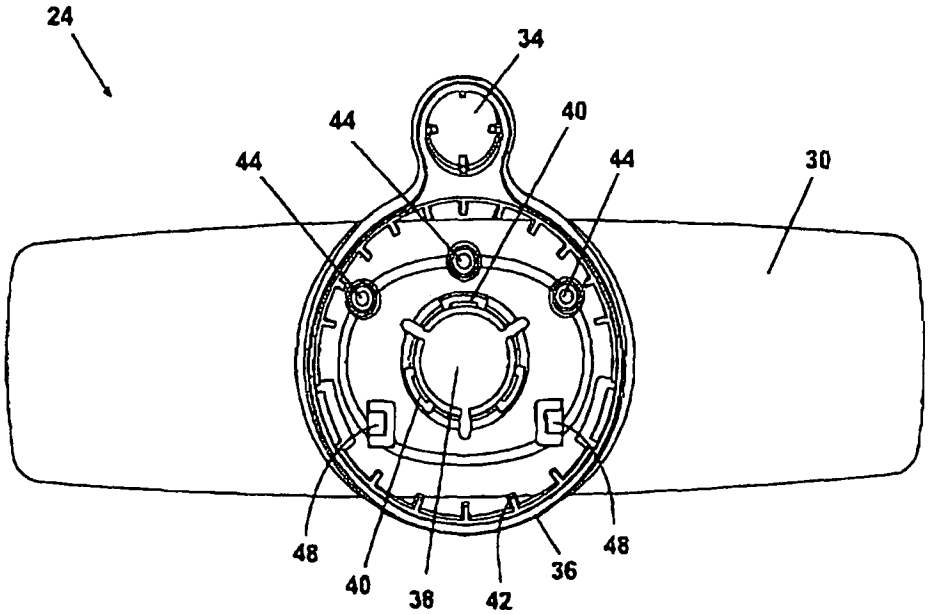
FIG. 3 is top view of an upper housing of the body of FIG. 2.
Figure 4:
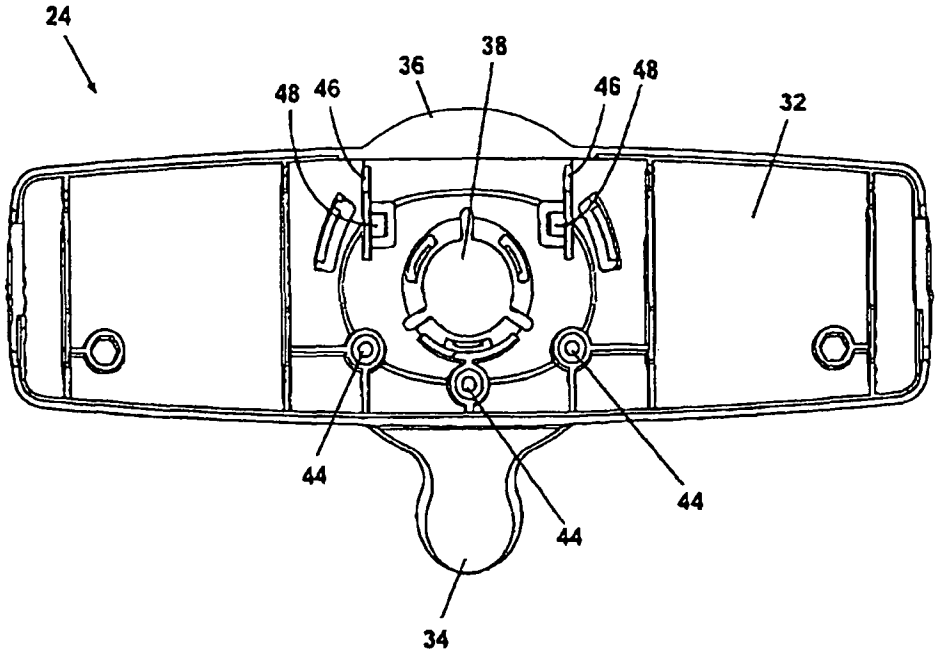
FIG. 4 is a bottom view of the upper housing of FIG. 3.

Referring to FIGS. 3 and 4, the body assembly 14 further comprises an upper housing 24, a nozzle assembly 26, and a brush assembly 28. The upper housing 24 further comprises an exterior surface 30 and an interior surface 32. A handle receiver 34 is integrally formed on a rear surface of the upper housing 24 and removably receives the second end of the handle assembly 14. A container receiver 36 is integrally formed on an upper surface of the upper housing 24 and removably receives the container 16. In one embodiment the container receiver 36 comprises a unique geometry that corresponds with a mating fitting on the container 16 so that standard containers are not compatible with the container receiver 36. In one embodiment, the unique geometry on the container 16 is formed by removing the finger pad portion of the unique spray-through cap to expose a valve stem 102, pedestal, and mounting cup on the container 16. The container receiver 36 design corresponds to the unique spray-through cap thus creating a unique geometry whereby only the unique spray-through cap will mate with the container receiver 36. A container aperture 38 is formed through the upper housing 24 and is generally aligned with a longitudinal axis of the cleaner container 16. A pair of locking lever notches 40 is formed asymmetrically around a perimeter of the aperture 38. A plurality of stiffening ribs 42 are arranged about the perimeter of the container receiver 36 to provide strength to the receiver wall and support the container 16 as is commonly known in the art. A plurality of screw bosses 44 provides a mechanism to secure the upper housing 24 to the nozzle assembly 24 via screws or other commonly known fastening devices and techniques. The interior surface 32 of the upper housing 24 further comprises a pair of pivot arms 46, each of which incorporates a single pivot pin 48 that are axially aligned with each other between the pivot arms 46.

Figure 5:
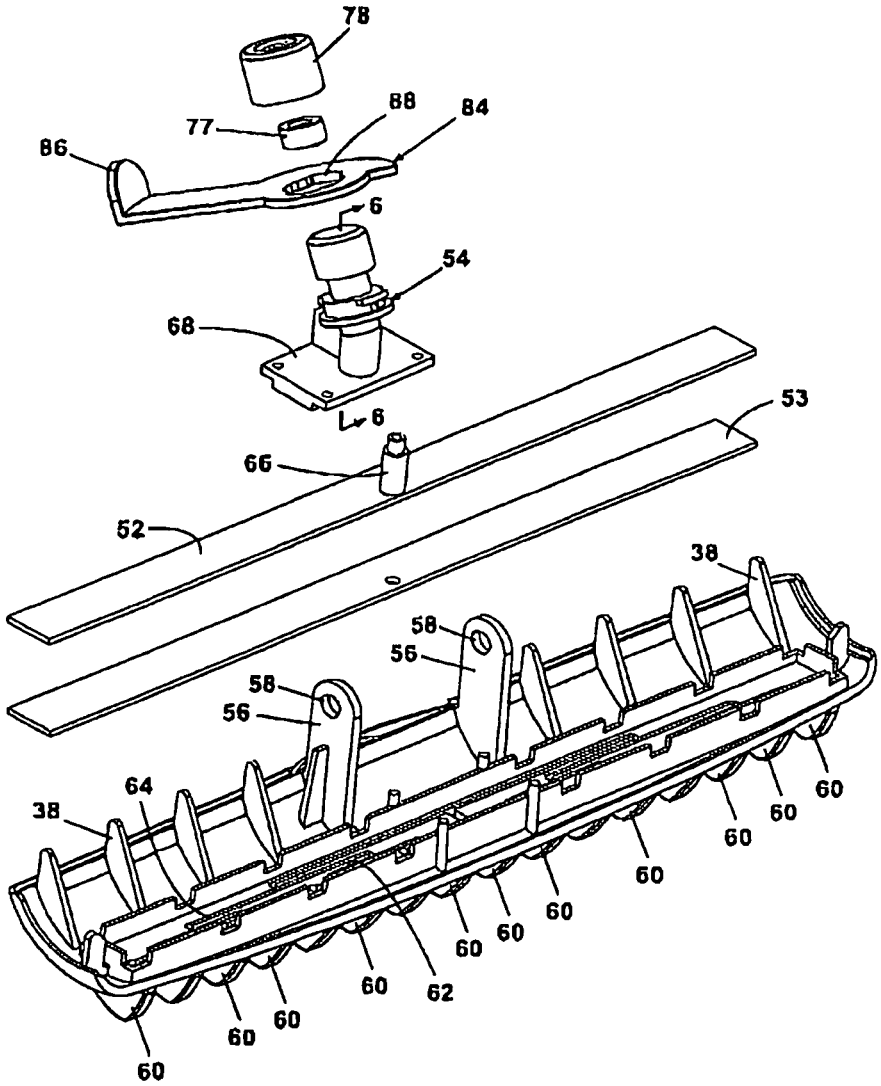
FIG. 5 is an exploded view of a nozzle assembly of the body of FIG. 2.

Referring to FIG. 5, the nozzle assembly 26 further comprises a nozzle housing 50, a manifold cover, 52, and an angle conduit 54. The nozzle housing further comprises a pair of support arms 56 that have through openings 58 at an upper portion thereof that receive the pivot pins 48 on the pivot arms 46 in the upper housing 24 to pivotally mount the nozzle housing 50 to the upper housing 24. A plurality of rake blades 60 are formed along a bottom and rear surface of the nozzle housing 50, each further comprising a fluid distribution conduit 62 formed therein. In one embodiment each rake blade 60 is ramped, i.e., a rearward portion of the rake blade is wider than a forward portion of the rake blade. Each of the fluid distribution conduits 62 are in fluid communication via a distribution channel 64 formed across the width of the nozzle housing 50. The manifold cover 52 further includes a manifold conduit 66 projecting upwardly therefrom and in fluid communication with the distribution channel 64. A manifold seal 53 is positioned between the manifold cover and the nozzle housing 50 to prevent leaking of fluid as it passes through the distribution channel 64. The manifold cover 52 is securely attached to the nozzle housing 50 via commonly known methods of heat staking, ultrasonic welding, adhesives, or screws.

Figure 6:
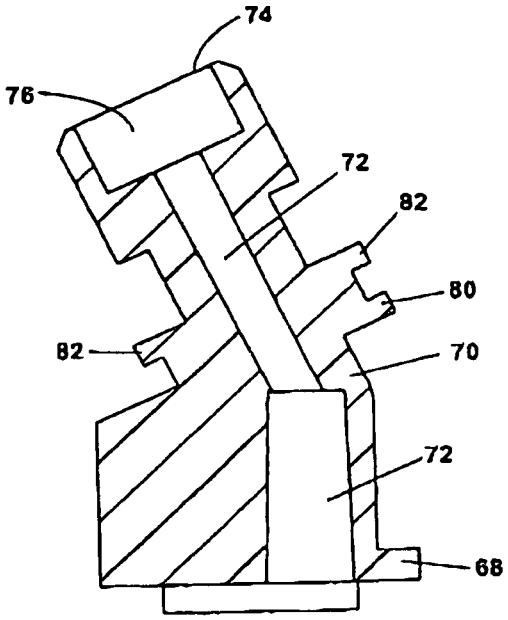
FIG. 6 is a sectional view taken through line 6-6 of FIG. 5.

Referring to FIGS. 5 and 6, the angle conduit 54 further comprises a base portion 68 integrally formed with a main body 70 and forming a fluid conduit 72 therethrough. The base portion 68 is fixedly mounted to the manifold cover 52 and surrounds the manifold conduit 66. A fluid inlet 74 is formed at the other end of the fluid conduit 72 and further comprises a cup seal retainer recess 76 that receives a seal 77 and a seal retainer 78. The main body 70 further comprises an annular flange 80 concentric with an upper portion of the fluid conduit 72. A pair of opposed locking ears 82 are positioned in spaced relation to the annular flange 80 and interface with a lock lever 84 that rotates about an outer surface of the main body 70 between the annular flange 80 and the locking ears 82. The lock lever 84 is a rigid elongate structure comprising a grip 86 on one end and an aperture 88 on an opposing end. The aperture 88 comprises a pair of opposed notches 90 that correspond with the locking ears 82 of the main body 70.

In an alternate configuration the seal 77, seal retainer 78, and angle conduit 54 can be replaced by an aerosol actuator and a flexible tube. The aerosol actuator comprises an L-shaped internal fluid conduit that is sealingly connected to the cleaner container valve stem 102 on an inlet side and to the flexible tube on an outlet side. The flexible tube is fluidly connected to the manifold conduit 66 formed on the manifold cover 52. The manifold cover 52 can further comprise an upwardly ramped protrusion formed at the center portion thereof.

Figure 7:
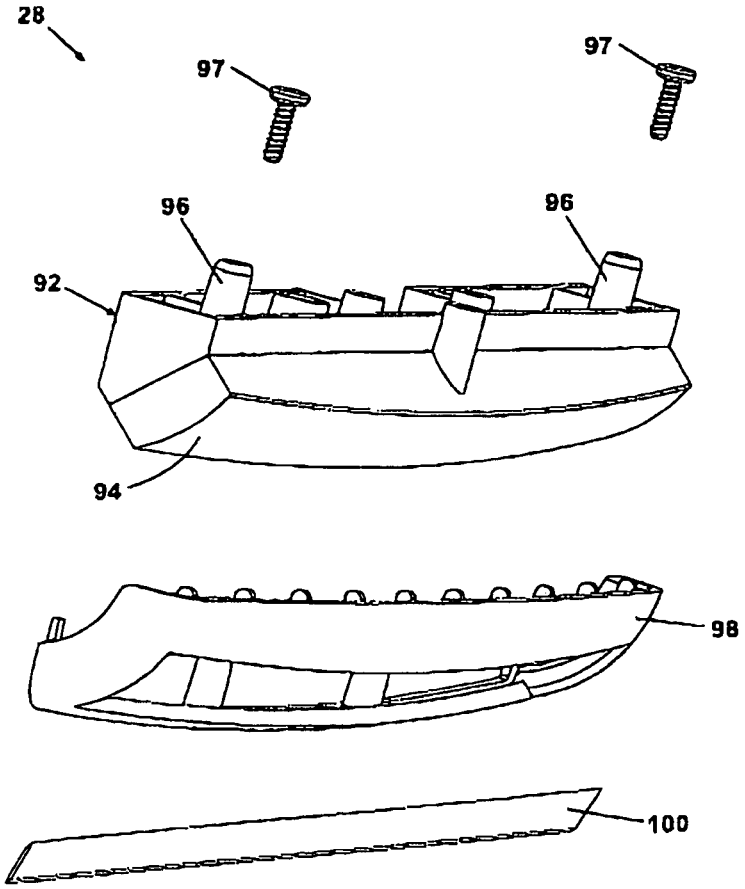
FIG. 7 is an exploded perspective view of a brush assembly of the body of FIG. 2.

Referring to FIG. 7, the brush assembly 28 further comprises a brush body 92 and a plurality of bristles 94. The brush body 92 incorporates a plurality of mounting bosses 96 for mechanical attachment to the upper housing 24 by a corresponding number of screws 97. A decorative bezel 98 surrounds the bristles 94 and snaps into place on the brush body 92 in a conventional manner. A squeegee 100 can be located on the brush body 92 or the bezel 98 for use on bare floor surfaces.

The container 16 is a conventional aerosol dispenser utilizing contents under pressure that are dispensed by engaging a commonly known valve assembly that includes a valve stem 102. Alternatively, the container 16 can be any type of container that dispenses a treating composition to the surface to be treated. For example, the container 16 can be a liquid container that feeds via gravity though a spring loaded normally closed valve or an optional commonly known pump assembly such as a trigger or battery powered motor coupled to a known pump. Furthermore, it is also contemplated that the invention can comprise more than one container 16 with each container storing a different treating composition. The treating composition(s) can include any fluid, solid, or gas that can be used to clean or otherwise treat the surface to be treated. By way of example, one container can store a standard carpet cleaning solution, and a second container can store a topical treatment, such as an anti-stain, anti-soil, miticide, or peroxide composition, or other commonly known carpet treatments. It is further anticipated that the invention can comprise a hybrid whereby one of the containers 16 is an aerosol container and a second container is a liquid container.

Figure 8:
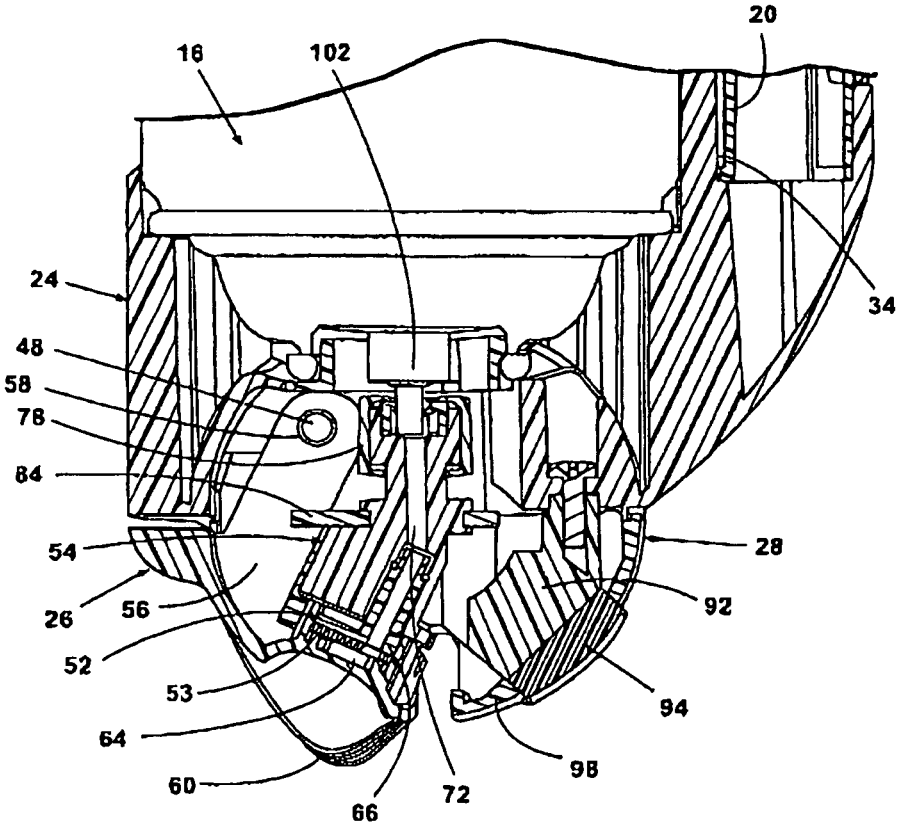
FIG. 8 is a partial sectional view taken through line 8-8 of FIG. 1, showing the dispenser in the off position.
Figure 9:
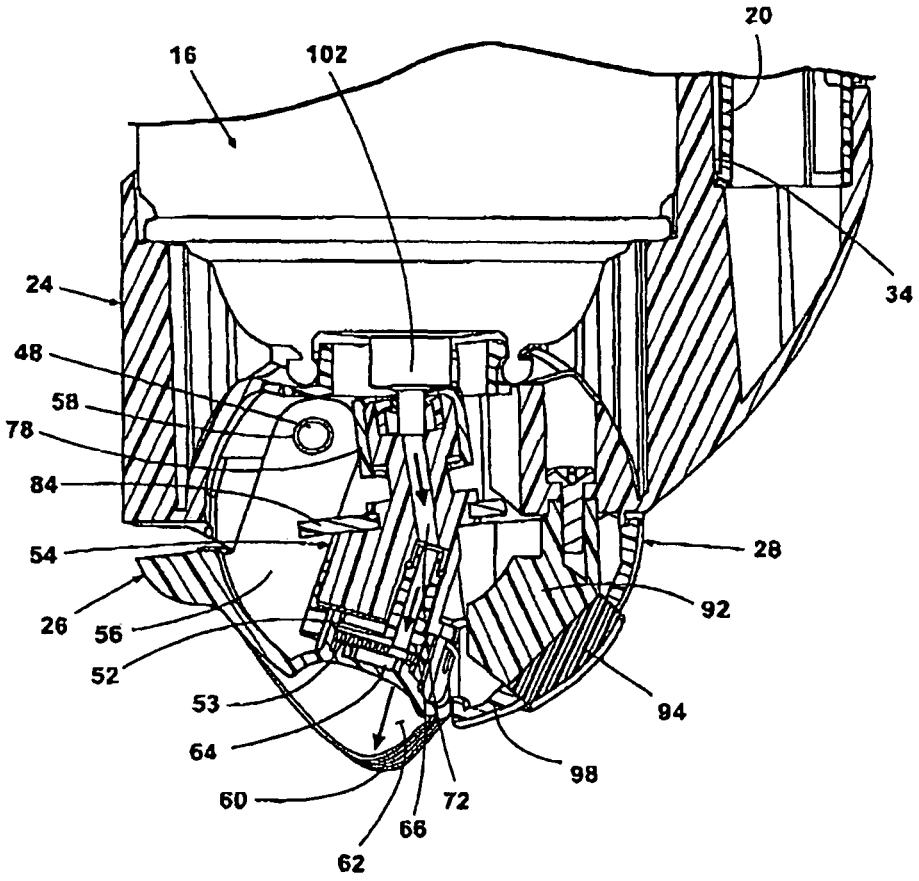
FIG. 9 is a partial sectional like FIG. 8 but showing the dispenser in the on position.

Referring to the figures and particularly to FIGS. 7, 8 and 9, the treating implement 10 is readied for use the lock lever grip 86 is moved to the left as the user is facing the nozzle assembly 26 and placed in a "lock" position. With the lock lever 84 in the "lock" position, the locking lever notches 90 are offset from the locking ears 82 on the angle conduit 54 and thus prevent the angle conduit 54 from moving. A full container 16 is inverted and placed in the container receiver 36 formed in the upper housing 24 so that the valve stem 102 slides within the cup seal retainer 78 and the sides of the container 16 are aligned with the container receiver 36 of the upper housing 24. To dispense the treating composition from the container 16, the lock lever is moved to the right and placed in an "unlock" position. With the lock lever 84 in the "unlock" position, the locking lever notches 90 are aligned with the locking ears 82 on the angle conduit 54.

Figure 10:
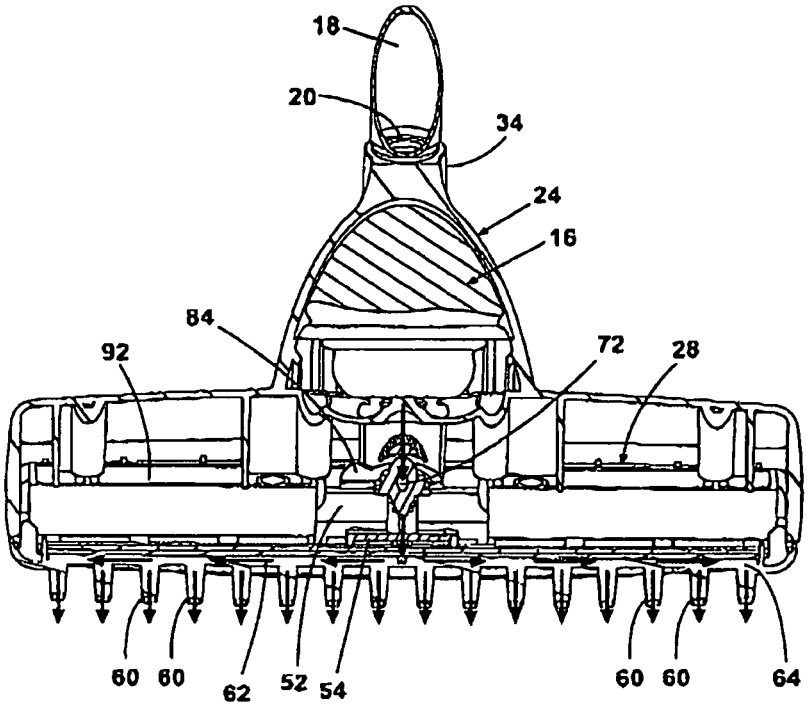
FIG. 10 is a sectional view taken through line 10-10 of FIG. 1.

Referring to FIGS. 9 and 10, to use the treating implement 10, the user grasps the handle 12 at a convenient location with the body 14 oriented in a downward position. The user places the nozzle assembly 26 on the surface to be treated and pushes down on the handle 12. The downward force causes the nozzle assembly 26 to rotate about the pivot pins 48 associated with the upper housing 24 which, in turn, moves the manifold cover 52 and angle conduit 54 in a generally upward direction so that the valve stem 102 of the container 16 is forced upward. Upward movement of the valve stem 102 releases the treating composition from the container 16 to flow, as shown by arrows, through the cup seal retainer 78, through the fluid conduit 72, through the manifold conduit 66 and into the distribution channel 64 within the nozzle housing 50. Now referring to FIG. 9, the fluid is distributed across the distribution channel 64 as shown by arrows and through the individual distribution conduits 62 formed in each of the rake blades 60. On carpeted surfaces, the rake blades penetrate the carpet nap and extend near the carpet backing thus separating the carpet fibers so that the treating composition can flow deep down into the carpet fibers. The treating composition can be further worked into the carpet by repeated downward stroking with either the rake blades 60 or brush bristles 94. In one embodiment, the treating composition is a heavy traffic formulation that can be dried on the surface to be treated and can be subsequently removed via conventional vacuum cleaning.

Other embodiments of the treating implement not specifically shown herein are possible. For example, the treating implement can be adapted for use on bare floors by use of the optional squeegee 100. Furthermore, the rake blades 60 can be combined with additional bristles 94 for an alternate agitation device.

While the invention has been specifically described in connection with certain specific embodiments thereof, it is to be understood that this is by way of illustration and not of limitation, and the scope of the appended claims should be construed as broadly as the prior art will permit.

What is claimed is:

1. A surface treating implement, comprising:

a body comprising;

an upper housing including a container receiver; and a nozzle assembly adapted to engage a surface to be cleaned comprising a fluid conduit fluidly connected to the container receiver, wherein the nozzle assembly is mounted to the upper housing for movement between a fluid discharge position and a fluid retention position;

at least one container selectively mounted to the container receiver and containing a predetermined amount of a treating composition and having a dispensing opening in fluid communication with the fluid conduit; and a handle connected to the upper housing;

wherein the nozzle assembly is pivotally mounted to the upper housing for selective displacement with respect thereto of a predetermined distance to release the treating composition from the at least one container through the fluid conduit and onto a surface to be treated; and wherein the at least one container has a valved opening and the nozzle assembly has an actuator that interfaces with a valve in the valved opening to displace the valve with respect to the container receiver to discharge the treating composition from the at least one container as the nozzle assembly moves between the fluid retention position and the fluid discharge position.

2. The surface treating implement according to claim 1, and further comprising a plurality of rake members formed on the nozzle assembly.

3. The surface treating implement according to claim 2, wherein at least one of the plurality of rake members comprises a ramped surface.

4. The surface treating implement according to claim 2, wherein the rake members are adapted to penetrate carpet fibers on the surface to be treated and at least one fluid distribution conduit is adapted to distribute the treating composition near a base of the carpet fibers.

5. The surface treating implement according to claim 2, wherein at least a portion of the fluid conduit extends through the plurality of rake members.

6. The surface treating implement according to claim 1, and wherein the container receiver comprises a unique geometry that is complementary to a mating unique geometry on the container.

7. The surface treating implement according to claim 1, and further comprising a brush assembly adapted to agitate the surface to be treated after the treating composition has been applied to the surface to be treated.

8. The surface treating implement according to claim 7, wherein the brush assembly is mounted to the nozzle assembly.

9. The surface treating implement according to claim 1, and further comprising a squeegee assembly affixed to the body.

10. The surface treating implement according to claim 1, wherein the at least one container is an aerosol container adapted to dispense fluid under pressure.

11. The surface treating implement according to claim 1, wherein the at least one container is a liquid container adapted to dispense fluid by gravity feeding.

12. The surface treating implement according to claim 1 wherein the at least one container is an aerosol container.

13. The surface treating implement according to claim 12, wherein the valve comprises a valve stem, and the nozzle assembly has an actuator that interfaces with the valve stem to displace the valve stem with respect to the container receiver to discharge the treating composition from the aerosol container as the nozzle assembly moves between the fluid retention position and the fluid discharge position.

14. The surface treating implement according to claim 1, wherein the treating composition comprises a cleaning solution.

15. The surface treating implement according to claim 1, wherein the treating composition comprises a topical treatment.

16. The surface treating implement according to claim 15, wherein the topical treatment comprises an anti-stain, anti-soil, miticide, or peroxide composition.

* * * * *